US011120924B2

(12) United States Patent
Lu et al.

(10) Patent No.: US 11,120,924 B2
(45) Date of Patent: Sep. 14, 2021

(54) CABLE AND A COMBINED CABLE

(71) Applicants: Tyco Electronics (Shanghai) Co. Ltd., Shanghai (CN); TE Connectivity Services GmbH, Schaffhausen (CH)

(72) Inventors: Hainan Lu, Dongguan (CN); Wei Yao, Kunshan (CN); Kevin Edward Weidner, Middletown, PA (US)

(73) Assignees: Tyco Electronics (Shanghai) Co. Ltd., Shanghai (CN); TE Connectivity Services GmbH, Schaffhausen (CH)

( * ) Notice: Subject to any disclaimer, the term of this patent is extended or adjusted under 35 U.S.C. 154(b) by 0 days.

(21) Appl. No.: 16/851,237

(22) Filed: Apr. 17, 2020

(65) Prior Publication Data

US 2020/0335241 A1 Oct. 22, 2020

(30) Foreign Application Priority Data

Apr. 18, 2019 (CN) ..... 201910306182.8

(51) Int. Cl.
*H01B 7/08* (2006.01)
*H01B 3/42* (2006.01)

(52) U.S. Cl.
CPC ..... *H01B 7/0807* (2013.01); *H01B 3/427* (2013.01); *H01B 7/0869* (2013.01)

(58) Field of Classification Search
CPC .. H01B 7/0807; H01B 7/0823; H01B 7/0241; H01B 7/0216; H01B 7/0225; H01B 11/002; H01B 11/203; H01B 11/20; H01B 11/02; H01B 11/08; H01B 11/10
See application file for complete search history.

(56) References Cited

U.S. PATENT DOCUMENTS

2011/0315419 A1* 12/2011 Grant ..... H01B 11/06 174/34
2012/0298395 A1* 11/2012 Gundel ..... H01R 13/5845 174/105 R
2017/0133125 A1* 5/2017 Janssen ..... H01B 11/203
2017/0256837 A1* 9/2017 Ishikawa ..... H01B 1/02
2017/0309370 A1* 10/2017 Tanaka ..... H01B 7/02
2020/0168359 A1* 5/2020 Kohori ..... H01B 9/003

* cited by examiner

*Primary Examiner* — Hoa C Nguyen
*Assistant Examiner* — Amol H Patel
(74) *Attorney, Agent, or Firm* — Barley Snyder

(57) ABSTRACT

A cable includes a pair of wires each having a conductor and a wire insulation layer wrapped around the conductor, an inner insulation layer wrapped around the wire insulation layer of each of the wires and fixing the wires, a metal shielding layer wrapped around an outer surface of the inner insulation layer, and an outer insulation layer wrapped around an outer surface of the metal shielding layer. The metal shielding layer has an insulating substrate and a metal conductive layer coated on the insulating substrate. The metal conductive layer of the metal shielding layer faces the outer insulation layer.

17 Claims, 3 Drawing Sheets

CABLE AND A COMBINED CABLE

CROSS-REFERENCE TO RELATED APPLICATION

This application claims the benefit of the filing date under 35 U.S.C. § 119(a)-(d) of Chinese Patent Application No. 201910306182.8, filed on Apr. 18, 2019.

FIELD OF THE INVENTION

The present invention relates to a cable and, more particularly, to a cable having a pair of wires.

BACKGROUND

In the prior art, as shown in FIG. 1, a cable structure 10' of a high-speed cable comprises two wires 1', one ground wire 5', a metal shielding layer 3' being longitudinally wrapped around the two wires 1' and the one ground wire 5', and an insulation layer 4' being then wrapped around the metal shielding layer 3' to fix the metal shielding layer 3'.

The high-frequency test bandwidth that the cable structure 10' can achieve, however, is low. Further, the stability is not good and the ground wire 5' is also easily misaligned during bending of the cable structure 10'.

SUMMARY

A cable includes a pair of wires each having a conductor and a wire insulation layer wrapped around the conductor, an inner insulation layer wrapped around the wire insulation layer of each of the wires and fixing the wires, a metal shielding layer wrapped around an outer surface of the inner insulation layer, and an outer insulation layer wrapped around an outer surface of the metal shielding layer. The metal shielding layer has an insulating substrate and a metal conductive layer coated on the insulating substrate. The metal conductive layer of the metal shielding layer faces the outer insulation layer.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
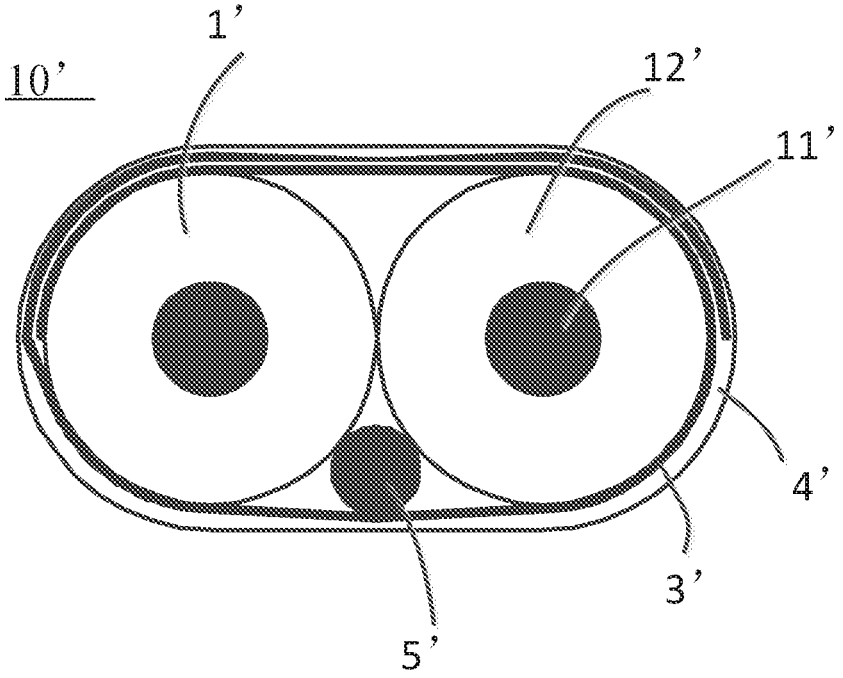
[PRIOR ART] Fig. 1
FIG. 1 is a sectional view of a cable according to the prior art.

Although the present disclosure will be fully described with reference to the accompanying drawings including embodiments of the disclosure, before the description, it should be understood that modifications may be made to the disclosure herein by those skilled in the art. Therefore, the description is to be understood as a broad disclosure for those skilled in the art, and is not intended to be limited to the exemplary embodiments described herein.

In addition, in the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
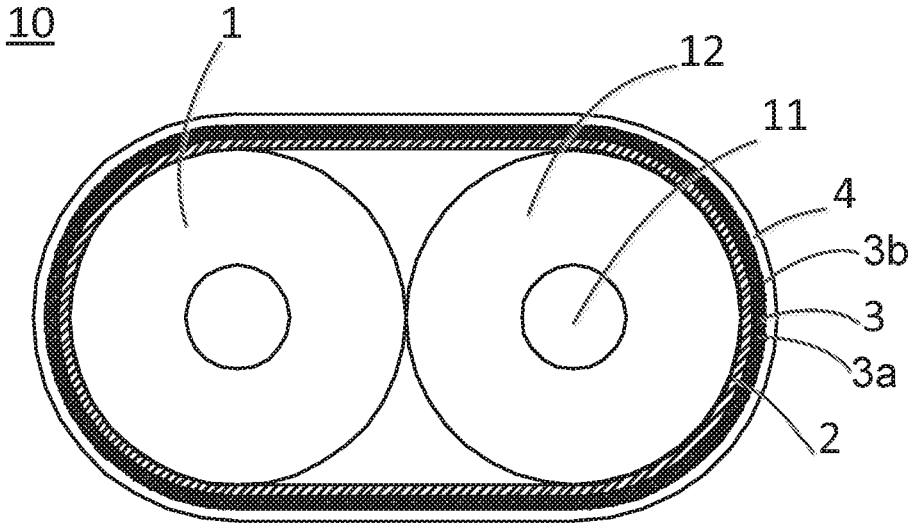
FIG. 2 is a sectional view of a cable according to an embodiment of the invention.

A cable 10 according to an embodiment, as shown in FIG. 2, comprises a pair of wires 1 for transmitting a signal, each of the wires 1 including a conductor 11 and a wire insulation layer 12 wrapped around the conductor 11. The cable 10 also comprises an inner insulation layer 2, a metal shielding layer 3, and an outer insulation layer 4.

As shown in FIG. 2, the inner insulation layer 2 is longitudinally wrapped around the wire insulation layer 12 of the two wires 1 to fix the two wires 1 and prevent the metal shielding layer 3 from entering a gap between the two wires 1. The metal shielding layer 3 is wrapped around an outer surface of the inner insulation layer 2 has an insulation substrate 3*a* and a metal conductive layer 3*b* coated to the insulating substrate 3*a*. The outer insulation layer 4 is wrapped around an outer surface of the metal shielding layer 3, with the metal conductive layer 3*b* of the metal shielding layer 3 facing the outer insulation layer 4, so that the metal shielding layer 3 can be used as a ground wire, thereby eliminating the separate ground wire and reducing the cost of the entire cable 10. In addition, the high-frequency test bandwidth that the cable 10 can achieve may be more than 40G, and the performance of the cable 10 is more stable.

In the embodiment shown in FIG. 2, the inner insulation layer 2 is suitable for being bonded to outer surfaces of the two wires 1, for example, by hot-melt, including hot-melting the inner insulation and/or the outer surfaces of the wires together without the use of an adhesive. In the shown embodiment, the inner insulation layer 2 is made of an insulation polymer material. For example, the inner insulation layer 2 is made of polyethylene terephthalate ("PE" for short).

In the embodiment shown in FIG. 2, the metal shielding layer 3 is suitable for being bonded to the outer surface of the inner insulation layer 2, for example, by hot-melt. That is, the substrate 3*a* of the metal shielding layer 3 is suitable for being bonded to the outer surface of the inner insulation layer 2, for example, by hot-melt. In an embodiment, the metal conductive layer 3*b* of the metal shielding layer 3 is made of aluminum or copper. However, it should be noted that those skilled in the art should understand that in some other embodiments of the present disclosure, the metal conductive layer 3*b* of the metal shielding layer 3 may also be made of other conductive materials.

In the embodiment shown in FIG. 2, the outer insulation layer 4 is suitable for being bonded to the outer surface of the metal shielding layer 3, for example, by hot-melt. The outer insulation layer 4 is made of an insulation polymer material. For example, the outer insulation layer 4 is made of polyethylene terephthalate ("PE" for short). In the shown embodiment, the outer insulation layer 4 is a plurality of sub-insulating layers superimposed on one another. That is, the outer insulation layer 4 may comprise a plurality of sub-insulating layers.

In the embodiment shown in FIG. 2, the cable 10 is flat, so that it can also be referred to as a flat cable.

Figure 3:
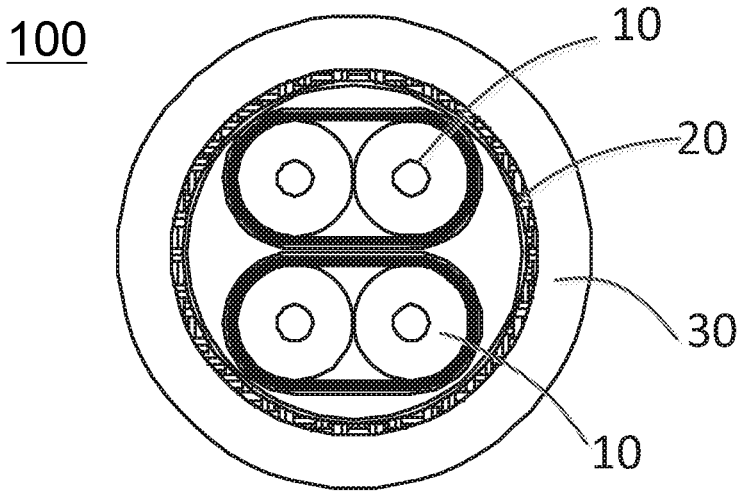
FIG. 3 is a sectional view of a combined cable according to an embodiment.
Figure 4:
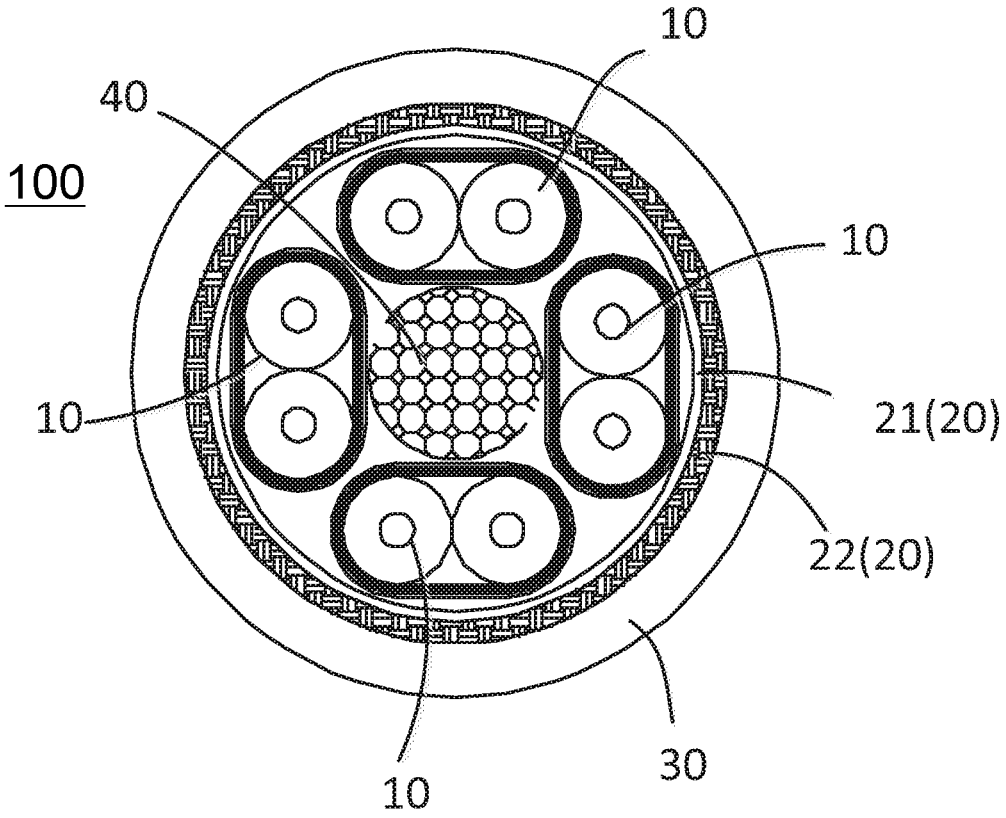
FIG. 4 is a sectional view of a combined cable according to another embodiment.
Figure 5:
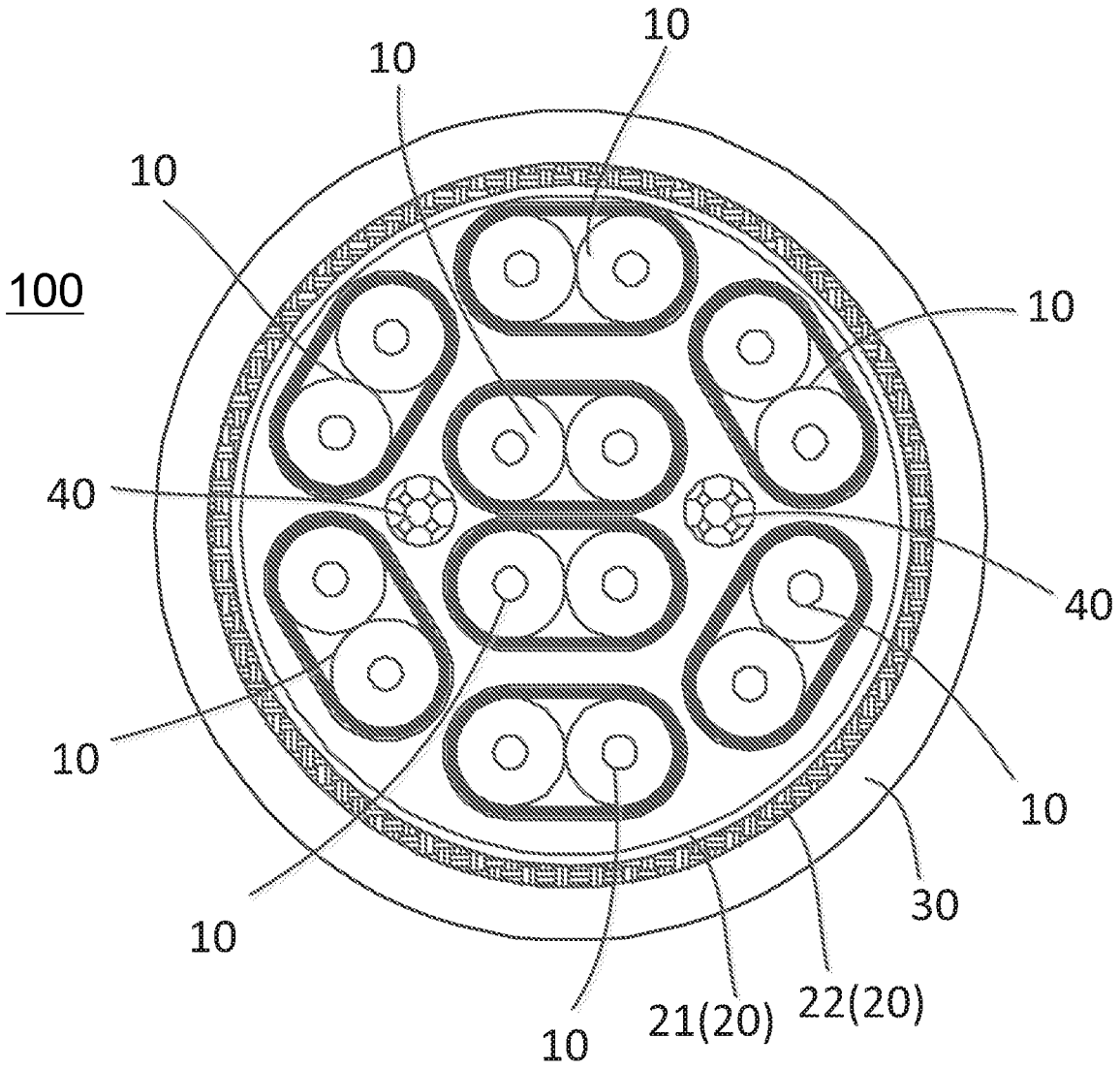
FIG. 5 is a sectional view of a combined cable according to another embodiment.

A combined cable 100 according to various embodiments is shown in FIGS. 3-5. The combined cable 100 includes at least a pair of cables 10 and an outer jacket 30 located at an outermost portion of the combined cable 100.

Each of the at least two cables 10, as described with reference to FIG. 2 above, has two wires 1 for transmitting a signal, each of the wires 1 including a conductor 11 and a wire insulation layer 12 wrapped around the conductor 11. The cable 10 also includes an inner insulation layer 2, a metal shielding layer 3, and an outer insulation layer 4. The inner insulation layer 2 is wrapped around the wire insulation layer 12 of the two wires 1 to fix the two wires 1 and preventing the metal shielding layer 3 from entering a gap between the two wires 1. The metal shielding layer 3 wrapped around an outer surface of the inner insulation layer 2 has an insulation substrate 3*a* and a metal conductive layer 3*b* coated to the insulating substrate 3*a*. The outer insulation layer 4 is wrapped around an outer surface of the metal shielding layer 3, the metal conductive layer 3*b* of the metal shielding layer 3 facing the outer insulation layer 4, so that the metal shielding layer 3 can be used as a ground wire, thereby eliminating the ground wire and reducing the cost of the entire cable 10. In addition, the high-frequency test bandwidth that this cable 10 structure can achieve may be more than 40G, and the performance of the cable 10 is more stable.

The combined cable 100, as shown in FIGS. 3-5, includes a shielding layer 20 wrapped around the at least two cables 10. In the shown embodiments, the shielding layer 20 has an inner shielding layer 21 wrapped around the at least two cables 10 and an outer shielding layer 22 wrapped around the inner shielding layer 21.

In the embodiments of the combined cable 100 shown in FIGS. 4 and 5, at least one portion of a gap of the at least two cables 10 is filled with a filler 40.

The at least two cables 10, as shown in FIGS. 3-5, are distributed radially symmetrically about a center of the combined cable 100. Specifically, there are two cables 10 in the embodiment shown in FIG. 3, four cables 10 in the embodiment shown in FIG. 4, and eight cables 10 in the embodiment shown in FIG. 5. However, it should be noted that those skilled in the art should understand that in some other embodiments of the present disclosure, the combined cable 100 may also include six cables 10, ten cables 10, etc., or may also include an odd number of cables 10, such as three cables 10, five cables 10, etc.

In the embodiment shown in FIG. 4, the combined cable 100 includes four cables 10, a filler 40 is disposed at the center of the combined cable 100, and the four cables 10 are distributed around the filler 40 located at the center.

In the embodiment shown in FIG. 5, the combined cable 100 includes eight cables 10, two of the eight cables 10 are located at the center of the combined cable 100, and the other six cables of the eight cables 10 are distributed around the two cables 10 located at the center of the combination cable 100.

It should be appreciated for those skilled in this art that the above embodiments are intended to be illustrative, and not restrictive. Many modifications may be made to the above embodiments by those skilled in this art, and various features described in different embodiments may be freely combined with each other without conflicting in configuration or principle. Although several embodiments have been shown and described, it would be appreciated by those skilled in the art that various changes or modifications may be made in these embodiments without departing from the principles and spirit of the disclosure, the scope of which is not limited to the implements of the example embodiments set forth in the specification.

What is claimed is:

1. A cable, comprising:

a pair of wires each having a conductor and a wire insulation layer wrapped around the conductor;

an inner insulation layer wrapped around and bonded to an outer surface of the wire insulation layer of each of the wires and fixing the wires, the inner insulation layer bonded to the outer surface of each of the wires via hot-melting at least one of the inner insulation layer or the outer surface of each of the wires without the use of an adhesive;

a metal shielding layer wrapped around and bonded to an outer surface of the inner insulation layer, the metal shielding layer having an insulating substrate and a metal conductive layer coated on the insulating substrate; and an outer insulation layer wrapped around an outer surface of the metal shielding layer, the metal conductive layer of the metal shielding layer facing the outer insulation layer.

2. The cable of claim 1, wherein the inner insulation layer is made of an insulating polymer material.

3. The cable of claim 2, wherein the inner insulation layer is made of polyethylene terephthalate.

4. The cable of claim 1, wherein the metal shielding layer is bonded to the outer surface of the inner insulation layer via hot-melting between the metal shielding layer and the outer surface of the inner insulation layer.

5. The cable of claim 4, wherein the metal conductive layer of the metal shielding layer is made of aluminum or copper.

6. The cable of claim 1, wherein the outer insulation layer is bonded continuously to the entire outer surface of the metal shielding layer.

7. The cable of claim 1, wherein the outer insulation layer has a plurality of sub-insulating layers superimposed on one another.

8. The cable of claim 1, wherein the cable is flat.

9. A combined cable, comprising:

a filler occupying the center of the combined cable;

a plurality of cables distributed radially about a center of the combined cable, each of the plurality of cables including:

a pair of wires each having a conductor and a wire insulation layer wrapped around the conductor, an inner insulation layer wrapped around and bonded to an outer surface of the wire insulation layer of each of the wires and fixing the wires, the inner insulation layer bonded to the outer surface of the pair wires via hot-melting at least one of the inner insulation layer or the outer surface of the pair wires without the use of an adhesive, a metal shielding layer wrapped around an outer surface of the inner insulation layer, the metal shielding layer having an insulating substrate and a metal conductive layer coated on the insulating substrate, and an outer insulation layer wrapped around an outer surface of the metal shielding layer, the metal conductive layer of the metal shielding layer facing the outer insulation layer; and an outer jacket located at an outermost portion of the combined cable.

10. The combined cable of claim 9, further comprising a shielding layer wrapped around the plurality of cables.

11. The combined cable of claim 10, wherein the shielding layer has an inner shielding layer wrapped around the plurality of cables and an outer shielding layer wrapped around the inner shielding layer.

12. The combined cable of claim 9, wherein the plurality of cables are distributed around a perimeter of the filler.

13. The combined cable of claim 12, wherein the plurality of cables comprises four cables including a first pair cables arranged generally parallel with one another on respective first opposite sides of the filler and a second pair of cables arranged generally parallel with one another on respective second opposite sides of the filler, each of the first pair of cables arranged generally orthogonal to each of the second pair of cables.

14. A combined cable, comprising:

a plurality of cables including a first plurality of cables and a second plurality of cables, the first plurality of cables including at least two cables located at a center of the combined cable, the second plurality of cables arranged radially about the center of the combined cable and surrounding the first plurality of cables, the second plurality of cables comprises a first pair of cables arranged generally parallel with one another on respective first opposite sides of the center of the combined cable, a second pair of cables arranged generally parallel with one another on respective second opposite sides of the center of the combined cable, and a third pair of cables arranged generally parallel with one another on respective third opposite sides of the center of the combined cable, each of the plurality of cables including:

a pair of wires each having a conductor and a wire insulation layer wrapped around the conductor, an inner insulation layer wrapped around the wire insulation layer of each of the wires and fixing the wires, a metal shielding layer wrapped around an outer surface of the inner insulation layer, the metal shielding layer having an insulating substrate and a metal conductive layer coated on the insulating substrate, and an outer insulation layer wrapped around an outer surface of the metal shielding layer, the metal conductive layer of the metal shielding layer facing the outer insulation layer;

an outer jacket located at an outermost portion of the combined cable;

a first filler disposed on a first side of the first plurality of cables and between the first plurality of cables and one of the cables of the first pair of cables and one of the cables of the second pair of cables of the second plurality of cables; and a second filler, discrete from the first filler, disposed on a second side of the first plurality of cables opposite the first side and between the first plurality of cables and the other one of the cables of the first pair of cables and the other one of the cables of the second plurality of cables, wherein the first filler and the second filler are not disposed between the first plurality of cables and the third pair of cables.

15. The combined cable of claim 14, wherein for each of the plurality of cables, the inner insulation layer is bonded to an outer surface of each of the wires via hot-melting at least one of the inner insulation layer or the outer surface of each of the wires without the use of an adhesive.

16. The combined cable of claim 14, wherein for each of the plurality of cables, the metal shielding layer is bonded to the outer surface of the inner insulation layer via hot-melting.

17. The combined cable of claim 14, wherein the outer insulation layer is continuously bonded about the entire outer surface of the metal shielding layer.

* * * * *